US010021966B2

(12) United States Patent
Ortiz et al.

(10) Patent No.: US 10,021,966 B2
(45) Date of Patent: Jul. 17, 2018

(54) PAINT BRUSH WITH MODIFIED HANDLE

(71) Applicants: Mark Ortiz, Queens, NY (US); Don Levy, New York, NY (US)

(72) Inventors: Mark Ortiz, Queens, NY (US); Don Levy, New York, NY (US)

( * ) Notice: Subject to any disclaimer, the term of this patent is extended or adjusted under 35 U.S.C. 154(b) by 33 days.

(21) Appl. No.: 15/166,579

(22) Filed: May 27, 2016

(65) Prior Publication Data

US 2016/0345721 A1 Dec. 1, 2016

Related U.S. Application Data

(60) Provisional application No. 62/166,713, filed on May 27, 2015.

(51) Int. Cl.

| | |
|---|---|
| ***A46B 17/00*** | (2006.01) |
| ***B44D 3/12*** | (2006.01) |
| ***B25G 1/00*** | (2006.01) |
| *B25G 3/00* | (2006.01) |

(52) U.S. Cl.

CPC ..... *A46B 17/00* (2013.01); *B25G 1/00* (2013.01); *B44D 3/123* (2013.01); *B25G 3/00* (2013.01)

(58) Field of Classification Search

CPC ..... A46B 17/00; A46B 17/02; A46B 15/0095; A46B 2200/202; A46B 2200/205; B44D 3/123

USPC ..... 15/159.1, 160, 246, 144.1, 144.3; 248/304, 305, 307

See application file for complete search history.

(56) References Cited

U.S. PATENT DOCUMENTS

| | | | | |
|---|---|---|---|---|
| 1,206,010 | A * | 11/1916 | Mackeever | A46B 17/02 248/685 |
| 3,197,795 | A | 8/1965 | Forte | |
| 3,336,617 | A | 8/1967 | Bosko et al. | |
| 3,432,875 | A * | 3/1969 | Edelson | B44D 3/123 15/246 |
| 4,010,510 | A * | 3/1977 | Belza | A46B 3/02 15/186 |
| 4,157,598 | A | 6/1979 | Talent et al. | |
| 4,887,327 | A * | 12/1989 | Meimeteas | A46B 17/00 15/168 |
| 5,752,287 | A | 5/1998 | Wheat | |
| 6,163,920 | A | 12/2000 | Meyer | |
| 8,566,999 | B1 | 10/2013 | Casey | |

* cited by examiner

*Primary Examiner* — Laura C Guidotti

(74) *Attorney, Agent, or Firm* — Eric Brandon Lovell; Timothy Marc Shropshire; US IP Services, P.C.

(57) ABSTRACT

A paint brush with a modified handle features a handle that is elongated in comparison to a conventional paint brush, and provides hooks for hanging the brush on the rim of a paint can. The lower end of the handle provides a threaded socket for affixing the brush on the end of a painting pole, enabling quick and easy touch-ups of any spots high above the floor or scaffold that were missed.

3 Claims, 3 Drawing Sheets

PAINT BRUSH WITH MODIFIED HANDLE

CROSS-REFERENCE TO RELATED APPLICATIONS

This application claims the benefit of U.S. Provisional Application No. 62/166,713, filed May 27, 2015, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to house painting equipment and supplies, and in particular to a paint brush with a modified handle. Painting the interior or exterior of a residence is a challenging task. The proper tools, including quality paint brushes and rollers, make the task a great deal easier. Unfortunately, brushes are most easily cleaned after the painting is done when only the tips of the bristles are coated with paint. The brushes tend to fall into open paint cans, making them far more difficult to clean. Also, touching up a few spots high above the floor or the scaffold can be very labor intensive.

A search of the prior art reveals various paint brushes and associated devices which have been developed to provide a means for painting higher elevated areas. None are closely related to the present invention, but several include features which resemble those of the present invention. Each has proven to be less than satisfactory in its own way.

Extension for paint brush handle, U.S. Pat. No. 8,566,999 (priority Nov. 9, 2009), provides a paint brush holder comprising an elongated cylindrical body having an open forward end portion and a coaxial reduced internal diameter rearward end portion, the tubular body forward end portion being dimensioned to slidably receive the paint brush handle and the tubular body forward end portion having an elongated narrow width slot therein extending from the cylindrical body open forward end to adjacent the reduced internal diameter rearward end portion; a threaded bolt extending perpendicularly from the paint brush handle and exterior of the cylindrical body through the elongated slot; and a nut threadably received on the bolt exteriorally of the cylindrical body whereby the paint brush handle may be lockably adjusted relative to the cylindrical body to thereby adjust the position of the brush bristles relative to the cylindrical body forward end.

Paint brush having detachable extension rod, U.S. Pat. No. 4,157,598 (filed Apr. 27, 1978), provides a paint brush, having a handle extending from a stock into which bristles are fastened is provided with and adapter to which an extension rod or pole may be attached. The adapter is connected to the stock adjacent to the termination of the handle in the stock, and at an angle to the handle. The adapter, handle and stock, are in coplanar arrangement. The adapter is constructed to releasably receive an extension rod, preferably in threaded engagement. With the extension rod, the improved paint brush may be used to paint floor and ceiling mouldings and the junction between floors and ceilings without the aid of a ladder.

Paint brush accessory, U.S. Pat. No. 6,163,920 (filed Apr. 16, 1998), provides a paint brush accessory mountable on a paint brush. The accessory includes a planar shield having a first edge and an opposed second end. A guide is carried on the shield adjacent the first edge for sliding engagement with a surface or edge to enable the shield to be guided in a straight line at an angle along the surface or edge. The guide is formed with an exterior surface disposed at an angle with respect to the plane of the shield to hold the shield at a constant angle from an adjoining wall when the first edge of the shield in engaged with a surface or edge. A holder is pivotally coupled to the second end of the shield to enable pivotal movement of the first end of the shield between a first position adjacent the bristles of a paint brush and a second position spaced from the bristles. The holder is releasably mountable on the paint brush handle.

Paint brush with elongated, adjustable handle, U.S. Pat. No. 3,197,795 (filed Feb. 21, 1964), provides a novel extension means for enabling painting operations to be done at elevated locations.

Screw paint brush, U.S. Pat. No. 5,752,287 (filed Oct. 1, 1996), provides a screw paint brush consisting of a connector which comprises a connector front and a connector rear having a connector rear opening therein. The screw paint brush further comprises a handle which comprises a handle front having a handle front fastening, member securely attached thereto. The handle further comprises a handle rear which is securely attached to the handle front by a handle middle. The handle rear further comprises a handle rear opening therein which functions to accept an extension pole therein. The handle front fastening members removably attachable within the connector rear opening. Alternatively, the handle and brush can be manufactured in a single piece. The screw paint brush further comprises a brush which comprises a brush rear and a brush front having a plurality of brush bristles extending therefrom and securely attached thereto. The brush rear is securely attached to the connector front. The connector may be a straight connector or angled connector.

Paint brush holder with telescopic handle sections, U.S. Pat. No. 3,336,617 (filed Jan. 12, 1965), provides a telescopic brush supporting device for reaching high work areas, comprising a plurality of tubular handle sections and provided with bores extending transversely therethrough at contiguous ends, and having bolt and wing nut means arranged to work in the bores provided in the ends of the sections to removably secure the sections together. The upper end of the uppermost section is formed to support a brush holder, said holder formed to removably secure the brush therewith, so a painter may reach and paint work areas normally beyond his reach.

Some of the prior art inventions require very skilled and well-practiced handling by the user, and all of them fail to secure the paint brush when not in use. The present invention has been developed for the purpose of addressing and resolving these disadvantages. A paint brush with a modified handle, which provides hooks for hanging the brush on the rim of a paint can and a threaded socket for affixing the brush on the end of a painting pole, would resolve these problems.

SUMMARY OF THE INVENTION

Accordingly, the invention is directed to a paint brush with a modified handle. The handle is elongated in comparison to a conventional paint brush, and provides hooks for hanging the brush on the rim of a paint can. The lower end of the handle provides a threaded socket for affixing the brush on the end of a painting pole, enabling quick and easy touch-ups of any spots high above the floor or scaffold that were missed.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
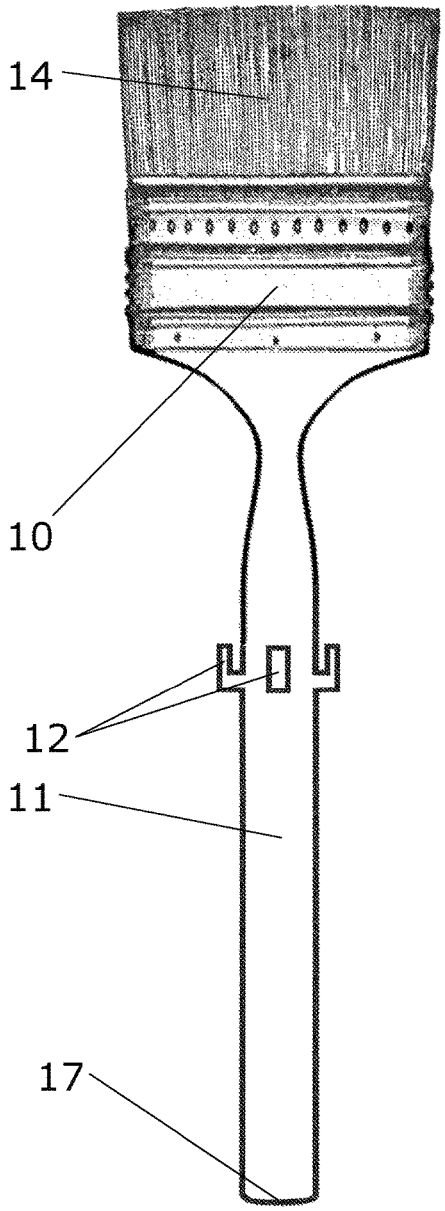
FIG. 1 is a front view of the first exemplary embodiment, displaying the brush 10, the handle 11, the hooks 12, the socket 13, and the bristles 14.
Figure 2:
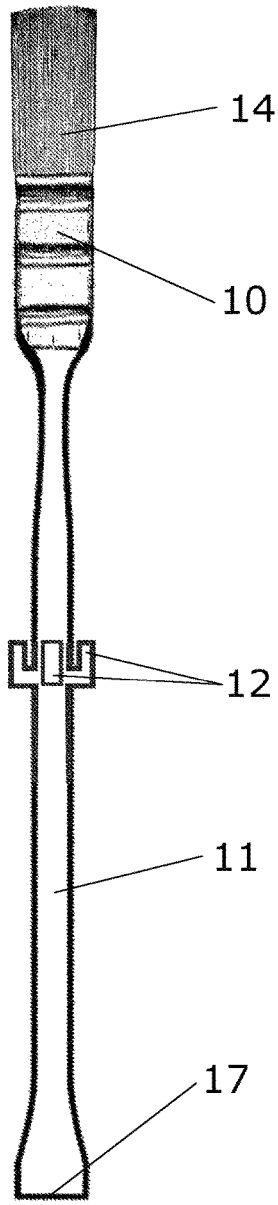
FIG. 2 is a side view of the first exemplary embodiment, displaying the brush 10, the handle 11, the hooks 12, the socket 13, and the bristles 14.
Figure 3:
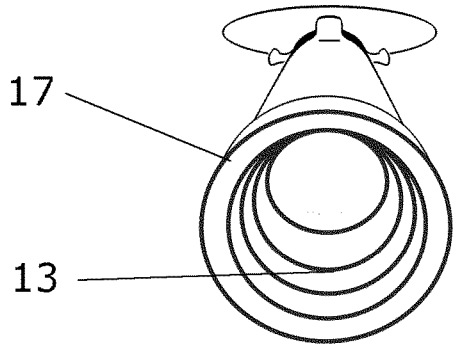
FIG. 3 is a bottom perspective view of the first exemplary embodiment, displaying the brush 10, and the socket 13.
Figure 4:
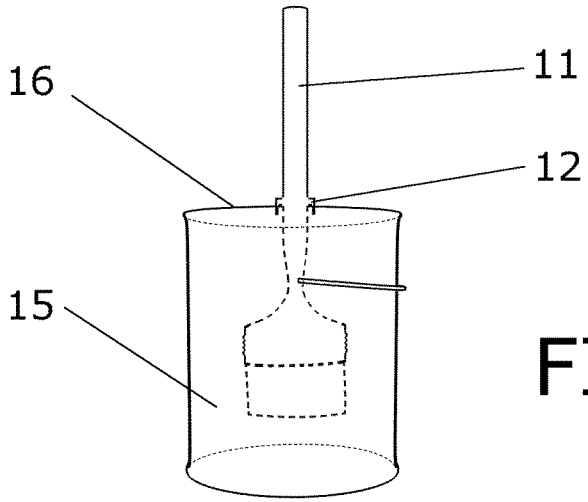
FIG. 4 is a side transparency view of a paint can with the first exemplary embodiment hanging from the rim, displaying the brush 10, the hooks 12, the can 15, and the rim 16.
Figure 5:
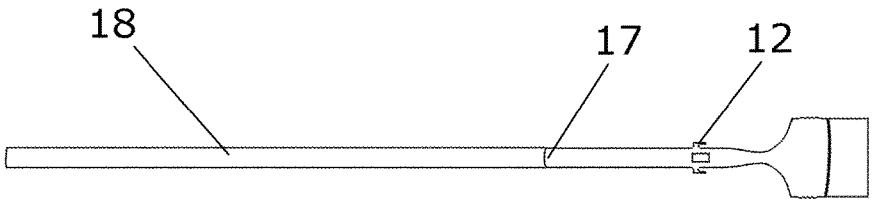
FIG. 5 is a side view of the first exemplary embodiment affixed to a painting pole, displaying the brush 10, and the pole 18.
Figure 6:
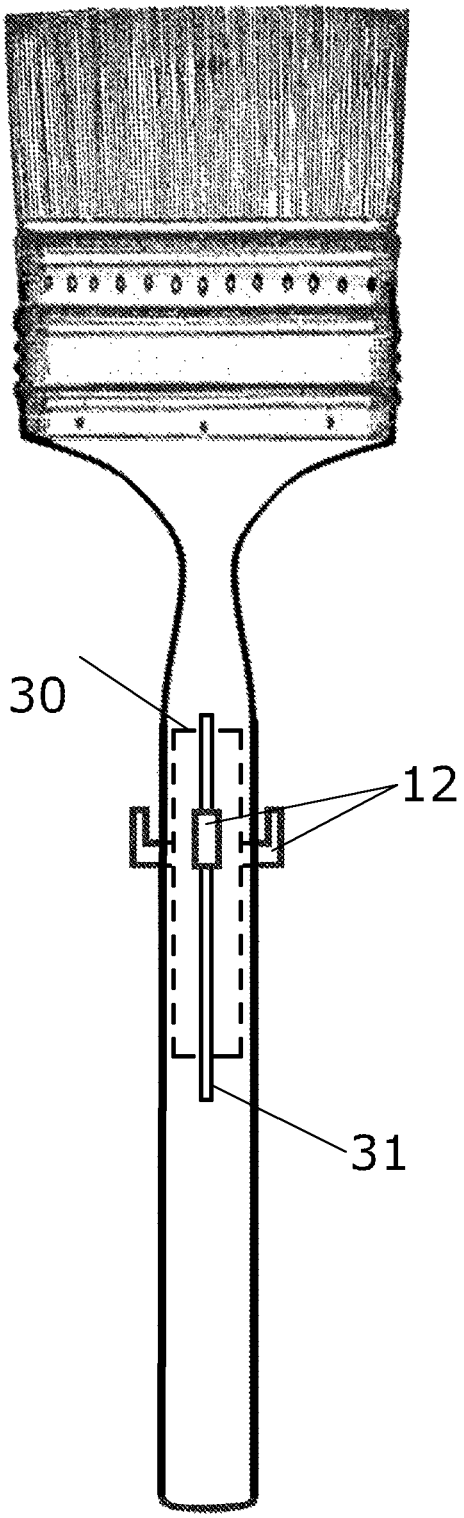
FIG. 6 is a front view of the second exemplary embodiment displaying the sliding insert 30 and vertical slots 31.

Referring now to the invention in more detail, the invention is directed to a paint brush 10 with a modified handle 11.

The first exemplary embodiment is comprised of a paint brush 10 which is similar in structure and function to a conventional paint brush, with the following modifications. The handle 11 is elongated in comparison to a conventional paint brush, and provides hooks 12 for hanging the brush 10 on the rim 16 of a paint can 15. The lower end of the handle 17 provides a threaded socket 13 for affixing the brush 10 on the end of a painting pole 18, such as those conventionally used with paint rollers, enabling quick and easy touch-ups of any spots high above the floor or scaffold that were missed.

The bristles 14 are preferably manufactured from a soft, fine material such as horsehair. The overall length of the brush 10 is preferably 15.5 inches to 16 inches, with a handle 11 that is preferably 12 inches in length. The overall width of the brush 10 is preferably 3.5 inches. Larger and smaller sizes are contemplated. Each hook 12 provides a 90° angle, rather than being curved like a fishhook, such that the shape of the hook 12 corresponds closely to the shape of the rim 16 for greater stability. The hooks preferably extend towards the bristles 14 of the brush 10 such that when the brush 10 is hung from the rim 16 of the paint can 15, the bristles 14 face downwardly into the paint can 15.

An alternate embodiment, providing hooks 12 which are adjustable, is also contemplated. For the alternate embodiment, the hooks 12 are molded as part of a sliding insert 30 within the handle 11, and protrude through vertical slots 31 provided in the handle 11. Once the position of the hooks 12 is adjusted by the user, the slide is secured in position within the handle 11 by friction and flexibility. This enables the user to suspend the bristles 14 at any desired height in the can 16.

To use the first exemplary embodiment, the user may hang the brush 10 on the rim 16 of a paint can 15, with the bristles 14 descending into the can 15, when desired. To paint a spot which is difficult to reach, the user may insert the threaded end of a painting pole 18 into the socket 13, turning the brush 10 clockwise to tighten the threads and secure the brush 10 to the pole 18.

The handle 11 and the hooks 12 are preferably manufactured from rigid, durable materials, such as hardened plastic or wood. The socket 13 is preferably manufactured from a rigid, durable material such as steel or aluminum alloy. The bristles 14 are preferably manufactured from a flexible, durable material which is soft, fine, and easily cleaned, such as horsehair or nylon fibers.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

We claim:

1. A paint brush with a modified handle, comprising:

a) an elongated handle having a lower end and an opposite end having bristles, the handle comprising two or more hooks protruding and disposed radially about the longitudinal axis of the handle, the two or more hooks being sized and configured to hang the paint brush from a rim of a paint can, wherein a position of each of the two or more hooks is adjustable such that the position of each of the two or more hooks is independently movable up and down the elongated handle.

2. The paint brush of claim 1, wherein the two or more hooks are affixed to a sliding insert within the elongated handle, the two or more hooks protruding through vertical slots provided in the handle.

3. The paint brush of claim 2, wherein the position of the two or more hooks is adjusted by sliding the two or more hooks up or down the vertical slots, wherein the sliding insert is held in place by friction.

* * * * *